US008425202B2

(12) United States Patent
Walls

(10) Patent No.: US 8,425,202 B2
(45) Date of Patent: Apr. 23, 2013

(54) MODULAR, UNIVERSAL AND AUTOMATIC CLOSED-LOOP PUMP PRESSURE CONTROLLER

(75) Inventor: James C. Walls, Mission Viejo, CA (US)

(73) Assignee: Xylem IP Holdings LLC, White Plains, NY (US)

( * ) Notice: Subject to any disclaimer, the term of this patent is extended or adjusted under 35 U.S.C. 154(b) by 1355 days.

(21) Appl. No.: 11/491,553

(22) Filed: Jul. 20, 2006

(65) Prior Publication Data

US 2007/0020108 A1 Jan. 25, 2007

Related U.S. Application Data

(60) Provisional application No. 60/701,968, filed on Jul. 21, 2005.

(51) Int. Cl.
*F04B 49/06* (2006.01)

(52) U.S. Cl.
USPC ..... 417/44.2; 417/44.11; 417/45

(58) Field of Classification Search ..... 417/44.2, 417/44.11, 45; 73/1.57, 1.66, 1.68; 702/98, 702/138, 50
See application file for complete search history.

(56) References Cited

U.S. PATENT DOCUMENTS 3,981,620 A * 9/1976 Abrahams et al. ..... 417/42
4,807,616 A * 2/1989 Adahan ..... 128/204.21
4,864,287 A * 9/1989 Kierstead ..... 340/648
5,221,189 A * 6/1993 Henningsen ..... 417/12
5,362,206 A * 11/1994 Westerman et al. ..... 417/12
5,520,517 A 5/1996 Sipin
5,664,937 A 9/1997 Takahashi et al.
5,725,357 A * 3/1998 Nakazeki et al. ..... 417/18
5,772,403 A 6/1998 Allison et al.
5,796,184 A * 8/1998 Kuhnl et al. ..... 307/118
6,022,195 A 2/2000 Gaudet et al.
6,050,918 A 4/2000 Kuramoto
6,074,170 A 6/2000 Bert et al.
7,083,392 B2 * 8/2006 Meza et al. ..... 417/44.2
2003/0206805 A1 * 11/2003 Bishop et al. ..... 417/44.2
2004/0009075 A1 * 1/2004 Meza et al. ..... 417/32

* cited by examiner

*Primary Examiner* — Charles Freay
*Assistant Examiner* — Christopher Bobish

(57) ABSTRACT

A universal controller (16) for an electric motorized pump (18) having a mechanical switch (19) for turning on and off electrical power to the pump, and method of operation of same. The controller controls output pressure of the pump based on controlling the speed of the pump (for example by applying voltage over a greater portion of a duty cycle), so as to provide an optimal operating pressure derived from an automatically determined value for the pressure at which the mechanical switch opens and disrupts electrical power to the pump. It is manufactured as a standalone assembly, not attached to a pump. It can be operated so as to automatically seek and determine a switch-opening pressure for the switch (19), at which the pump pressure switch opens and so interrupts electrical power to the motor, and to then choose an operating pressure below the switch-opening pressure.

20 Claims, 4 Drawing Sheets

MODULAR, UNIVERSAL AND AUTOMATIC CLOSED-LOOP PUMP PRESSURE CONTROLLER

CROSS REFERENCE TO RELATED APPLICATION

Reference is made to and priority claimed from U.S. provisional application Ser. No. 60/701,968 filed Jul. 21, 2005.

FIELD OF THE INVENTION

The present invention relates to a pump, and more particularly to a controller for a pump providing automatic variable speed control.

BACKGROUND OF THE INVENTION

Conventional small motorized positive-displacement diaphragm pumps use a mechanically-actuated electrical switch to control pump operation based on system pressure. Such a mechanical switch disadvantageously applies either full power or no power to a pump motor, causing the system pressure to pulse.

Improved systems utilize solid-state PWM (pulse width modulation) type power control, implemented with proportional pressure sensing for closed-loop operation, to vary the motor speed in proportion to the system demand for flow. This approach stabilizes system pressure in spite of changes in flow demand, reducing or eliminating system pressure pulsing. Existing designs for such pressure control provide the corresponding control circuitry integral with the pump being controlled.

Such an integral scheme requires a user to purchase the pump and controller both, to obtain the benefits of the controller. In other words, a user cannot use a pump of the user's own choosing and mate it with the closed-loop pressure controller because the controller is integral with or permanently attached to another pump, as manufactured.

SUMMARY

The present invention provides a controller of use in a range of different pumps having a mechanically-operated electrical pressure switch that stops current to the pump in case of excessive outlet pressure. A pump controller according to the invention can be operated so as to automatically seek and determine such a switch-opening pressure, i.e. the pressure at which the pressure switch opens and so interrupts electrical power to the motor. The pump controller can take the form of a single modular unit, programmable so that values of one or more control parameters and the specifics of their interpretation and response may be set and/or changed based on a desired operational performance for a wide variety of pumps. The pump controller can be manufactured as a standalone assembly, not attached to a pump, and is intended for use either with a pump having an integral, mechanically-operated electrical pressure switch, or with a pump system having a mechanically-operated electrical pressure switch external to a pump.

The seeking and determining of a switch-opening pressure is what is here called aligning of the controller to a detected switch-opening pressure for a pressure switch in such a way as to provide closed-loop pressure control at an optimal pressure for that pressure switch. The pump controller determines an operating point for constant running pressure that is "optimal" because it is sufficiently below the operating pressure of the pressure switch so as to avoid repeated switch action (commonly known as "switch cycling"), without being so low as to unnecessarily penalize the performance of the pump and surrounding fluid delivery system. This automatic pressure alignment activity occurs without direct human involvement and may be configured to continue to occur and re-occur over the life of the pump controller.

A pump controller according to the invention can thus combine closed-loop pressure control and automatic pressure alignment in a single modular unit that can be used with a wide variety of motorized, positive-displacement diaphragm pumps. The universal characteristic of a pump controller according to the invention gives the user the ability to select a conventional pump of the user's own choice. Further, the automatic pressure alignment function removes the requirement to set the unit for a particular operating pressure prior to use, because a pump controller according to the invention has the ability to determine the optimal operating pressure automatically, without requiring human intervention or assistance.

A method of automatically determining the optimal operating pressure provided by the invention may include one or more steps performed using a computer program executed on any suitable processing device or module, such as a microcontroller or microprocessor, or may include steps performed by an application specific integrated circuit (ASIC), in which case the processing device or module or the ASIC forms part of a pump controller according to the invention.

A pump controller according to the invention may take the form of tangible hardware that composes a control module, and may include a computer program product. Such a computer program product may have program steps for programming operation of a pump controller according to the invention so that the value of the one or more control parameters may be set and/or changed based on desired operational performance characteristics.

In typical operation, a universal pump controller according to the invention uses a microcontroller, combined with one or more computer programs, a pressure sensor integral to the pump controller, and power switching electronics. As such, the universal pump control "stands alone" and is not specific to any particular pump. Rather, it is made so as to be compatible with a range of pumps as defined by a collection of mechanical, electrical and hydraulic parameter value ranges.

To the extent that a pump controller according to the invention is programmable, it is possible for the controller to provide interpretive, dynamic and/or optimized behaviors unique to a given circumstance, and so transcending first-order reflexive response to changes in flow conditions. For example, a pump controller according to the invention can be tailored to incorporate fixed or variable time delays, or it can operate a pump at a single or multiple reduced or increased power levels, or it can attempt resumption of operation based on any number of decision criteria, or it can use configurable response criteria set at the time of manufacture or in the field.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION

Figure 1:
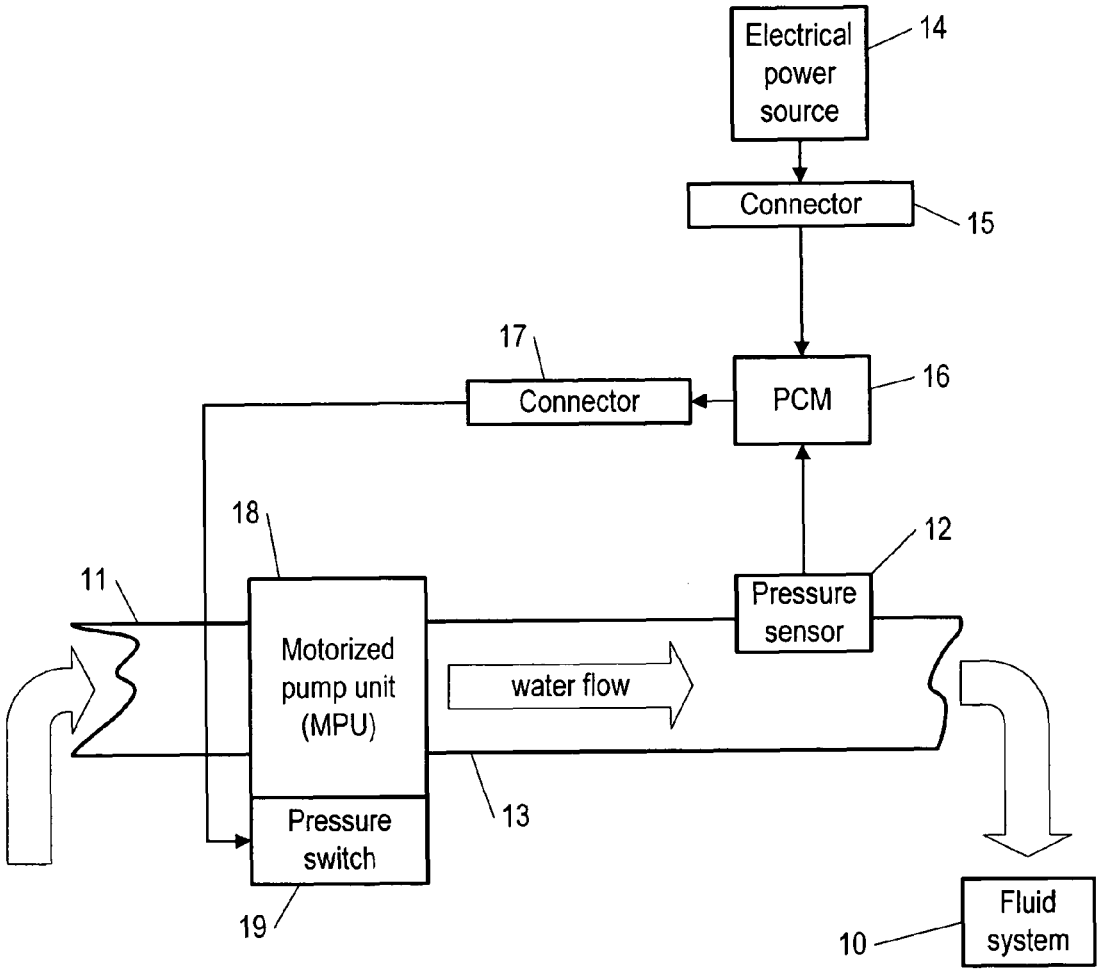
FIG. 1 shows a universal pump control typical system diagram according to the present invention.

Referring now to FIG. 1, a pump control module (PCM) 16 according to one embodiment of the invention is shown installed so as to control a motorized electric pump (MPU) 18 having a built-in pressure switch 19 that turns off power to a motor (not shown) of the MPU if the sensed pressure exceeds a switch-opening pressure. The MPU has inlet plumbing 11 and outlet plumbing 13. The outlet plumbing 13 supplies a fluid system 10 that is pressurized in normal operation. An AC or DC electrical power source 14 provides electrical power to the PCM through, electrical power connections 15. Electrical power to the MPU is provided via the PCM through electrical power connections 17 to the pressure switch 19 of the MPU; the pressure switch is electrically connected to the motor of the MPU. Hence, the PCM can sense current flowing to the pump motor, and control the voltage applied to the pump motor, connected in series with the pressure switch 19 of the MPU. The PCM receives pressure values at the outlet of the MPU from a pressure sensor 12, installed inline with the pressurized portion of the fluid system plumbing.

The PCM 16 maintains a constant system pressure (at the pump outlet in the embodiment shown in FIG. 1, although the invention is not so limited) by varying motor speed in response to changes in flow demand, employing the pressure sensor 12 to monitor the pressure. The pressure sensor 12 is advantageously a silicon piezo-resistive pressure sensor with no moving parts. As explained below, the PCM automatically measures the pressure at which the pressure switch 19 opens, turning power off to the MPU (i.e. interrupting current to the MPU), and then determines a lower value (lower than the limit value) for pressure to use as the operating pressure.

To determine the pressure value at which the pressure switch opens, (as sensed by the pressure sensor 12), the PCM increases the output pressure of the pump according to one or another predetermined algorithm (e.g. simply increasing the power to the pump linearly with time), until the pump eventually turns off. The PCM does this by increasing the voltage applied to the pump, which increases the speed of the pump. In some embodiments, to increase the voltage, the PCM includes a transistor/electronic switching device in series with the pump, and adjusts the on-state compared to the off-state (i.e. adjusts the duty cycle) of the transistor so as to apply more and more voltage. The pump is determined to turn off by sensing whether current is flowing to the pump during the on-state of the duty cycle. If no current is sensed during an on-state portion of the duty cycle, then it is assumed that the pressure switch 19 has opened, preventing current from flowing to the pump, i.e. the pressure at the outlet has reached a switch-opening pressure value, caused by the pump operating at higher and higher speeds because of more and more current reaching the pump due to the on-state portion of the duty cycle becoming a higher and higher percentage of the overall duty cycle. (Note that in at least some embodiments of the invention, the PCM controller does not receive pressure signals in only one period of a pump cycle, but instead monitors outlet pressure continuously, and does not operate any differently during different portions of a pump cycle.)

In an alternative embodiment, the voltage is actually increased until the pressure switch opens, i.e. instead of applying voltage over a greater portion of a duty cycle, a larger magnitude voltage is applied. Similar to the above, in this embodiment the PCM detects the operation of the pump pressure switch by monitoring the electrical current flowing through the PCM to the MPU.

The algorithm according to which the PCM increases the output pressure of the pump, may provide a more or less precise determination of the pressure at which the switch turns off power to the MPU (i.e. stops current from flowing to the MPU) by using a smaller or larger step size for increasing the power (i.e. for increasing the portion of the duty cycle over which voltage is applied, or for increasing the magnitude of the voltage). The value used for the switch-opening pressure is the value for the pressure sensed just before current is sensed as no longer flowing to the pump. The value so determined is always a lower limit on the pressure at which the switch opens (as measured by the pressure sensor 12), and as the step size is made smaller, the limit comes closer to the actual pressure at which the switch opens. In addition, commonly used digital and/or analog signal conditioning techniques (such as computing a running average and/or a low-pass analog filter) may be used to refine the result of the pressure measurement process.

Once a value for the opening pressure is determined, a formula is used to determine an operating pressure, i.e. the pressure to be maintained at the outlet of the pump by adjusting the motor speed (i.e. by adjusting the power to the pump motor).

The PCM 16 is a modular unit and is programmable so that values of one or more control parameters and the specifics of their interpretation and response may be set and/or changed based on a desired operational performance for a wide variety of pumps, as described herein.

In operation, the PCM 16 monitors the outlet pressure of the MPU/pump 18 over time, and may or may not also monitor electrical current drawn by the motor (not shown) included in and driving the pump. The PCM may reach decision points and respond to sensed pressure values based on operational assumptions, and/or pre-determined criteria, and/or adaptive learning behaviors. The operation of the PCM may be programmed using one or more computer programs provided as part of the PCM. The PCM acts on the pump via power control electronics, including any of a variety of suitable transistors, diodes, thyristors and commonly associated components.

The PCM 16 may also monitor and factor into its decision and response additional system parameters or control inputs in order to suit the particulars of a given application system or context, such as the inlet pressure (or vacuum), internal or external temperatures, external operational mode signals, supply voltage, override commands, emergency shutdown commands, motor RPM, and so on.

The PCM 16 may be designed to be compatible with AC (Alternating Current) or DC (Direct Current) systems and equipment.

The PCM 16 may be in the form of a single-piece unit, or may be realized in other assembly forms such as a control unit with the pressure sensor externally located from the control unit. Such variations in configuration accommodate and reflect installation and manufacturing trade-offs but do not change the function of the invention.

As a result of sensed pressure values, the PCM 16 may provide various different outputs, including control commands to a variable speed pump motor controller for the pump, standard or application-specific external alerting devices (providing visual alerts, audible alerts, and the like). The outputs may be provided as communications over wired or wireless networks, and in case of alerts, may be provided as synthesized or recorded speech. Proprietary or off-the-shelf communication platforms may be used.

The PCM 16 may include any of a variety of customized or standardized micro-computing devices such as a microprocessor or a micro-controller (hereafter referred to as MCU), one or more computer programs, electronic power control circuitry interfaced directly or indirectly to the microprocessor or micro-controller.

The PCM 16 may also include internal or external means of electrical current sensing, inputs and interface circuitry to accept values for control or monitored parameters, and means to support additional response outputs as described above, such as electronic and/or electromechanical switches, power output devices or modules, communications ports, illuminating devices, audio devices, galvanic interfaces, and the like.

Whether or not an MPU is compatible with a particular PCM according to the invention depends typically on the following operational parameters for the MPU: supply voltage type and magnitude (AC or DC), maximum electrical current draw, and operating pressure. A PCM is made according to the invention so as to be compatible with all pumps exhibiting values within prescribed value ranges of a particular set of operational parameters. The difference between a PCM compatible with one set of operational parameters and a second PCM compatible with a different set of operational parameters may include scale of power electronic circuitry (greater or lesser power capability), type of power control electronics (AC or DC, or specific devices used such as MOSFET or IGBT or TRIAC, etc.), pressure tolerances (such as for lower or higher ranges of system pressures), and behavioral characteristics such as determined by the computer program (such as closed-loop control stabilization via PID, modified PID or other techniques). The parameter sets and value range limits are determined by particular design choices for specific realized universal pump control products.

Additional operational parameters on which compatibility may hinge can include: type of pump (diaphragm, centrifugal, and so on), maximum system pressure developed at shut-off, minimum electrical current at one or more stated operating points, pump configuration (such as number of pumping chambers in a diaphragm pump), and type of motor (permanent-magnet brushed DC, AC rectified brushed permanent-magnet, AC induction, and so on).

For example, in a small pump application, a PCM according to the invention may be provided so as to be compatible with a pump having the following operational parameters: supply voltage: 10 to 30 volts DC, maximum electrical current draw: 12 amperes, minimum open flow current: 500 milliamperes, operating pressure: between 20 and 65 pounds per square inch, diaphragm pumps with 3-5 pumping chambers, and a permanent-magnet brushed DC motor.

Figure 2:
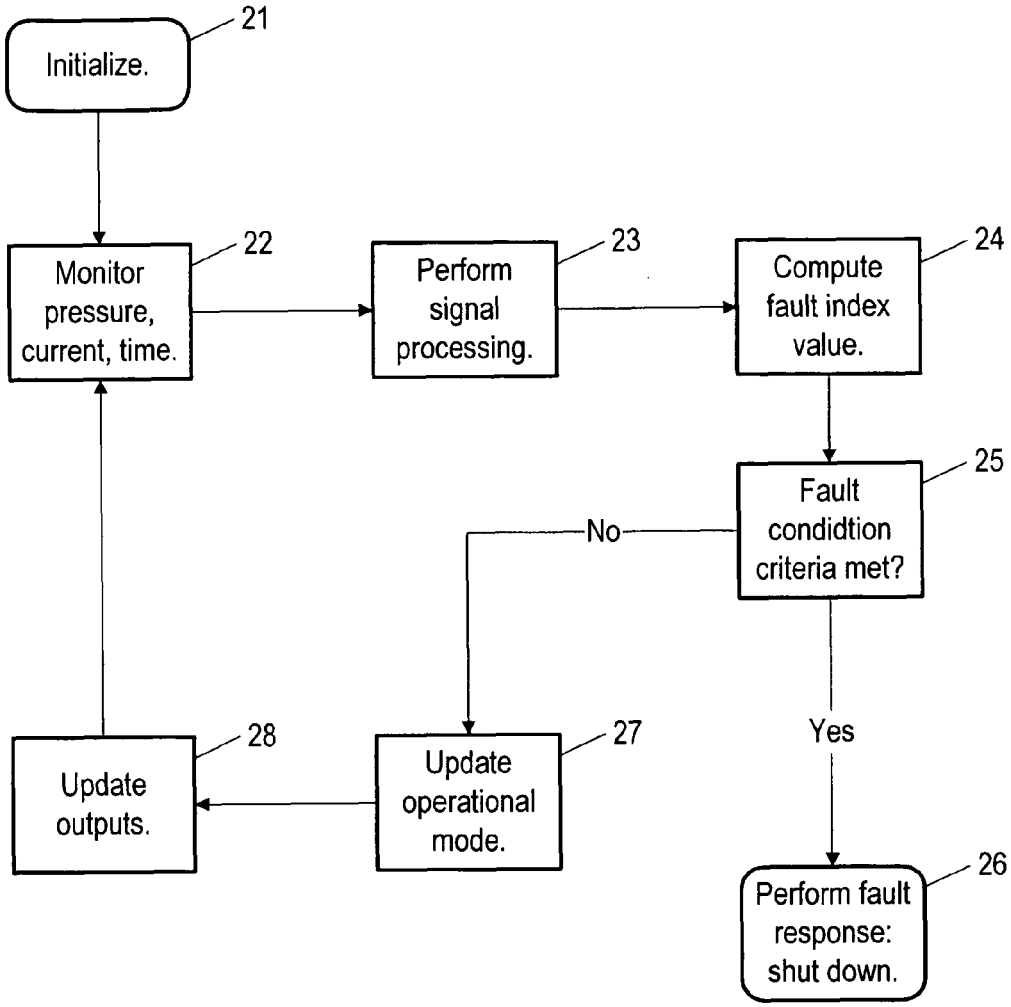
FIG. 2 shows an operational flowchart of a main routine having steps and/or modules for implementing the present invention.

FIG. 2: The Main Routine

FIG. 2 illustrates basic controlled-pressure operation of the PCM 16 (FIG. 1), and includes a first step 21 to initialize the PCM, and a next step 22 to monitor pressure, current, and time, with values for the pressure and current (and even possibly the time) being provided by equipment (sensors and possibly a clock) external or internal to the PCM 16. Next there is a step 23 to perform signal processing to determine digital values for the pressure, current and time corresponding to sensor signals and PWM duty cycle (reflecting voltage applied to the pump motor), a step 24 to compute a fault index value, a step 25 to determine if a fault condition criteria is met, and a step 26 of shutting down if the fault condition criteria are met, or alternatively, a step 27 to update the operational mode if the fault condition criteria is not met (such as by setting digital signal flags to indicate and track various states of operation), followed by a step 28 to update the PWM duty ratio for motor speed control and/or external communications or status outputs, such as mentioned previously. Operation then resumes with step 22 to monitor pressure, current, and time. (Such monitoring can be continuous, i.e. even while the other steps are being performed.)

Figure 3:
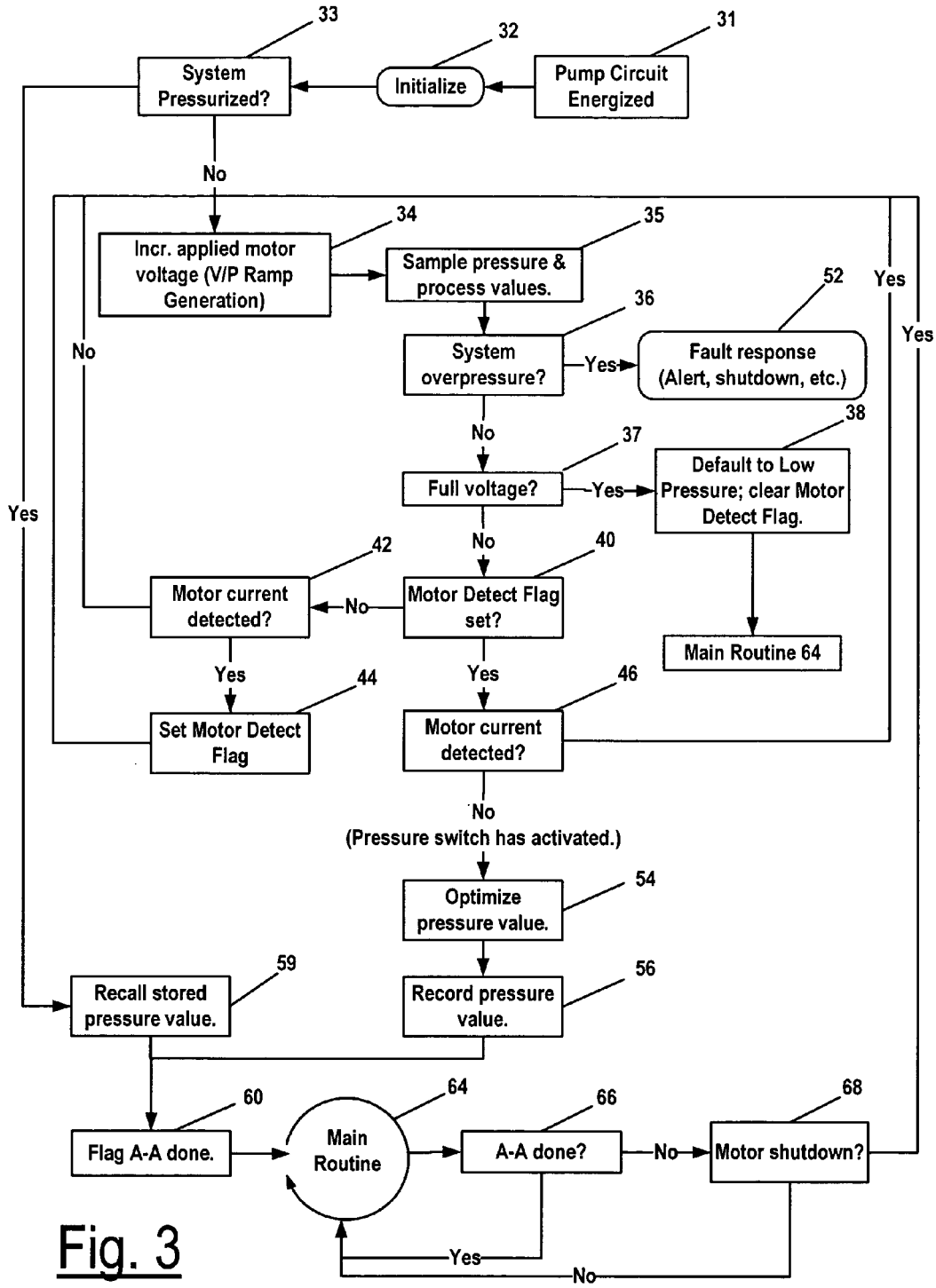
FIG. 3 shows an operational flowchart of a computer program having steps and/or modules for implementing the present invention of automatic pressure alignment.

FIG. 3: Automatic Pressure Alignment

As stated previously, the PCM 16 (FIG. 1) is manufactured without being attached to a specific pump and is intended for use with pumps having a mechanically-operated electrical pressure switch. At any time after installing a PCM 16 into a system served by the pump 18 (as when the pump is use in the field), the PCM can operate so as to automatically seek and determine a switch-opening pressure (operating point) of whatever pressure switch is in use with the pump. Each time electrical power 14 is applied to the PCM, it can seek and determine the pressure at which the pressure switch opens, i.e. the switch-opening pressure. The PCM will then align itself to the detected switch-opening pressure, i.e. it will seek to maintain a pressure at some value below the switch-opening pressure, using solid-state proportional power control of the motor driving the motorized pump 18 (FIG. 1).

Referring now to FIG. 3, operation of the PCM 16 (FIG. 1) for automatic pressure alignment is shown as including a step 31 of applying power to the system containing the PCM 16 and MPU 18, then an initialization step 32, followed by a step 33 of checking for the possibility that the fluid system 10 (FIG. 1), served by pump 18, is in a pressurized state at power-up. If the fluid system is pressurized at power-up, then a step 59 recalls the operating pressure value stored in memory and uses it as the operating pressure value.

If the fluid system is not pressurized at power-up, then a step 34 gradually increments the applied MPU motor voltage in a control loop designed to generate an upward ramp in the motor voltage. The motor voltage ramp causes a corresponding ramp upward in system pressure (pump outlet pressure), as the motor speed gradually increases in response to the increased voltage. The system pressure ramp allows for sufficiently accurate and consistent measurement of the pressure at which the switch opens.

Next, a step 35 serves to sample the system pressure and process the value obtained for the system pressure, such as by computing a running average pressure over some number of cycles through the control loop. This amounts to digital filtering and is a means of conditioning the pressure signal against uneven pulsations caused by pumping cycles. In addition, analog signal conditioning techniques (such as a low-pass analog filter) may be used alone or in conjunction with digital signal processing to refine the result of the pressure measurement process.

Next a step 36 checks if the system pressure has exceeded the maximum intended operating pressure range. If the maximum intended operating pressure range has been exceeded, then a step 52 executes a fault response, such as by issuing any of a number operator alerts and/or shutting down the pump.

If system pressure has not exceeded the maximum limit, then a step 37 checks to see if 100% of available system voltage is being applied to the motor. If so, then step 38 serves to set the operating pressure to a "low" pressure default and clears the Motor Detect Flag. The low pressure value is chosen to be high enough to allow a user to operate the pump at a flow sufficient to purge air from the fluid system, while still being low enough to allow the PCM 16 to accurately measure the switch-opening pressure value at a later time (as occurring in step 54 explained below). After step 38 completes, it transfers execution to step 64, which maintains closed-loop control of the fluid system pressure.

If on the other hand, step 37 indicates the applied motor voltage has not yet reached 100%, then step 40 checks to see if the motor has been previously detected as explained below. If no motor has been previously detected as indicated by a Motor Detect Flag, then step 42 checks for motor (electrical) current. If no motor current is detected, then the motor voltage increment loop is again entered at step 34. If motor current is detected, then the Motor Detect Flag is set in step 44 (indicating a motor has been detected as a result of observation of motor current by the PCM) and the motor voltage increment loop is re-entered at step 34.

If on the other hand step 40 finds that the Motor Detect Flag has been set, indicating that a motor has been previously detected, then step 46 checks for continued detection of motor current. If continued motor current is detected, then execution is transferred back to step 34 to continue increment of the motor voltage.

If, though, continued motor current is not detected in step 46 (i.e. the pressure switch has been activated, interrupting motor current), then a series of steps are performed, including a step 54 to optimize the pressure value according to system requirements, a step 56 to record an optimized pressure value in a memory store (such as non-volatile memory), and a step 60 to flag completion of the auto-alignment process.

Then a step 64 of maintaining closed-loop pressure control is performed (in a looping process, i.e. repeatedly) by adjusting the voltage applied to the motor in response to monitored system pressure, as in FIG. 2. The system pressure changes because of changes in demand for flow by user action and/or appliances connected to the fluid system to which the pump 18 is attached via the plumbing 11 and 13 (FIG. 1).

As step 64 executes, step 66 is performed to see if the auto-alignment process (indicated as A-A in FIG. 3) has been completed. If step 66 finds that the auto-alignment process has been completed, it returns execution to step 64.

If step 66 finds that auto-alignment has not been completed, step 68 checks the operational state of the PCM power control output for the pump. If the PCM is applying voltage to the pump, then the pump is not shut down, and program control returns to the step 64 for continuation of closed-loop pressure control. If step 68 finds that the motor is in shutdown (no voltage is being applied to the pump), then program control is transferred to step 34 in order to measure the pressure at which the pressure switch will open. This process is illustrated graphically in FIG. 4, as discussed below.

Figure 4:
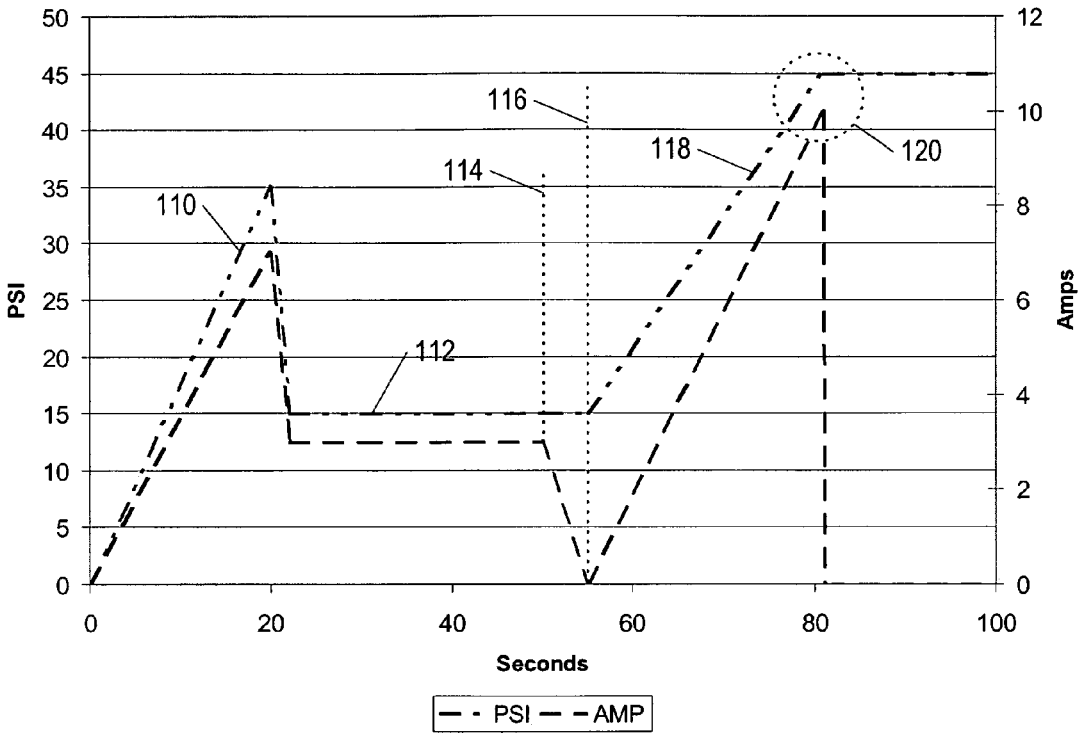
FIG. 4 illustrates a typical system initialization sequence involving automatic pressure alignment.

FIG. 4: Exemplary Execution Sequence

An exemplary execution sequence of the control operation for auto-alignment is depicted in FIG. 4, for the common situation of a user initializing a fresh water system in a boat or recreational vehicle (RV). Typical initialization practice in a boat or RV water system begins with the user opening flow valves and applying power to a pump in order to flood the pump and plumbing system with water, and purge air from both. In FIG. 4 a "Purge Ramp" 110 results from cyclical execution of a series of steps beginning with the step 34 (FIG. 3), where the voltage to the motor is gradually incremented. Due to a flow demand that exceeds the delivery capacity of the pump, the pressure does not ramp high enough to activate the pressure switch (in this situational example). Because the pressure switch does not activate, auto-alignment is not completed during this ramp.

Referring still to FIG. 4 and now also to FIG. 3, the point 112 in the sequence indicates an operating mode assumed in the step 38 (FIG. 3), where the PCM adopts a low operating pressure value upon failing to complete auto-alignment during the initial voltage/pressure ramp, i.e. the Purge Ramp 110. This low pressure value, for example 15 psi, allows the user to successfully purge air from the system while keeping the pressure low enough for a controlled pressure ramp later on.

At the point 114 in the sequence time, when all flow valves are closed, for example by a user content with the purging of the water system, the PCM observes declining values of electrical current drawn by the motor as a result of the PCM maintaining constant pressure in the system by varying the electrical voltage applied to the motor. In other words, as flow demand decreases, the amount of electrical power required to maintain system pressure also decreases. Because the PCM is controlling the voltage applied to the motor (and hence the current and so the power) and is also observing motor current, it is aware of the point (in time) 116 in the sequence at which motor shutoff occurs.

In FIG. 4, when the PCM detects motor shutoff 116 as a result of zero flow demand, it again initiates the voltage/pressure ramp sequence beginning with step 34 of FIG. 3. This action is triggered in the step 68 of FIG. 3. As FIG. 4 suggests, given zero flow, the pump is typically able to generate sufficient pressure during a zero flow ramp 118 to activate the pressure switch 19 (FIG. 1). At the moment the pressure switch 19 opens (event 120 in FIG. 4), the PCM 16 detects the cessation of electrical current flow to the MPU 18 in step 46.

Upon detecting pressure switch activation in the step 46 (FIG. 3), the PCM executes steps 54 through 56 (FIG. 3) to determine and record the optimal operating pressure. Step 60 then notes that the auto-alignment is completed. Finally, control is given to the main routine 64 for sustained operation at the optimal pressure value determined by auto-alignment.

The exact value of optimal constant pressure operation can be determined by empirical studies, resulting in "rules" or computational margins applied to the detected switch-opening pressure and pressure values obtained immediately prior to switch activation, to give a target operating pressure value.

The pressure values measured and computed for switch activation and constant pressure operation can of course be stored in various forms of digital memory, both volatile (RAM) and non-volatile (such as FLASH or EEPROM or conventional "hard drive" technology). Thus, observed and derived system operating parameter values may be retained and re-used or referenced after interruptions of electrical power to the PCM 16 where the fluid system remains pressurized, as in step 59 of FIG. 3.

Automatic pressure alignment activity according to the invention occurs without direct user involvement and may be configured to continue to occur over the life of the PCM. This continual alignment and realignment is advantageous in that it accommodates changes in the pump system over time, including even pump replacement or manual adjustment of the pump switch-opening pressure.

Regarding Implementation

By way of example, the functionality of the steps or modules shown expressly or impliedly in FIGS. 1-4 may be implemented using hardware, software, firmware, or a combination thereof, although the scope of the invention is not intended to be limited to any particular embodiment thereof. In a typical implementation, the steps or modules would be one or more microprocessor-based architectures having a microprocessor, a random access memory (RAM), a re-writeable (FLASH or EEPROM) or read only memory (ROM), input/output devices and control, data and address buses connecting the same, and a computer program. Thus, the functionality described above can be implemented as software/firmware modules stored in a digital memory, and executed as needed by a processor. Alternatively, the logic provided by such software/firmware can also be provided by an ASIC (application specific integrated circuit). In case of a software/firmware implementation, the invention can be provided as a computer program product including a computer readable storage structure embodying computer program code—i.e. the software—thereon for execution by a computer processor. A person skilled in the art would be able to program such a processor-based implementation to perform the functionality described herein without undue experimentation.

The scope of the invention is not intended to be limited to any particular implementation using technology known or later developed in the future. Moreover, the scope of the invention is intended to include an implementation of the inventive functionality in one stand alone module, in separate steps or modules, or in combination with other circuitry for implementing other steps or modules.

Possible Applications

By way of illustration, the invention can be applied to the control of pressurized water system pumps, such as found in potable and non-potable water systems in vehicles, vessels, structures and modular or mobile platforms, and to the control of pressurized fluid system pumps, such as found in beverage dispensers or commercial and industrial fluid systems.

Conclusion

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A controller, comprising:

one or more modules configured for:

receiving from a pressure sensing device a signal indicative of pressure in a fluid system connected to an outlet of a pump;

providing a voltage signal to the pump, and sensing whether current flows to the pump in consequence of the voltage signal provided; and determining a limit on the pressure at which current no longer flows to the pump in consequence of the voltage signal provided, based at least partly on the signal indicative of pressure at the outlet of the pump, and based at least partly on an algorithm for increasing the voltage signal provided to the pump in order to increase the speed and output pressure of the pump until current is no longer sensed as flowing to the pump in consequence of the voltage signal provided indicating that a pressure switch connected to the pump turned off the pump.

2. A controller as in claim 1, wherein the one or more modules is configured for determining the limit on the pressure using as the limit the pressure in the fluid system connected to the pump outlet just prior to increasing the voltage signal provided to a value for which current is no longer sensed as flowing to the pump.

3. A controller as in claim 1, wherein the one or more modules is configured for determining an operating output pressure for the pump based at least on the limit on the pressure.

4. A controller as in claim 1, wherein the voltage signal is increased by increasing the portion of a duty cycle during which the voltage signal is provided to the pump.

5. A controller as in claim 1, wherein the voltage signal is increased by increasing the magnitude of the voltage signal provided to the pump.

6. A controller system, comprising a controller as in claim 1, and further comprising a pressure sensor, for providing the signal indicative of pressure at the outlet of the electric pump.

7. A controller according to claim 1, wherein the one or more modules is a pump control module comprising a processor, microprocessor or microcontroller configured to implement the algorithm.

8. The controller of claim 7, wherein the processor, microprocessor or microcontroller is further configured to: determine an operating output pressure for the pump based at least on the limit on the pressure.

9. A method, comprising:

receiving from a pressure sensing device a signal indicative of pressure in a fluid system connected to an outlet of a pump;

providing a voltage signal to the pump, and sensing whether current flows to the pump in consequence of the voltage signal provided; and determining a limit on the pressure at which current no longer flows to the pump in consequence of the voltage signal provided, based at least partly on the signal indicative of pressure in the fluid system connected to the outlet of the pump, and based at least partly on an algorithm for increasing over time the voltage signal provided to the pump in order to increase the speed and output pressure of the pump until current is no longer sensed as flowing to the pump in consequence of the voltage signal provided indicating that a pressure switch connected in series with the pump turned off the pump.

10. A method as in claim 9, wherein in determining the limit on the pressure, the limit is set to the fluid system pressure existing just prior to increasing the voltage signal provided to a value for which current is no longer sensed as flowing to the pump.

11. A method as in claim 9, further comprising: determining an operating output pressure for the pump based at least on the limit on the pressure.

12. A method as in claim 9, wherein the voltage signal provided is increased by increasing the portion of a duty cycle during which voltage signal is provided to the pump.

13. A method as in claim 9, wherein the voltage signal is increased by increasing the magnitude of the voltage signal provided to the pump.

14. A pump system comprising:

a pump unit having outlet plumbing and configured to pump a fluid to a fluid system;

a pressure switch connected in series to the pump unit and configured to turn the pump unit off if the pressure of the pump exceeds a switch-opening pressure of the pressure switch;

a pressure sensor coupled to the outlet plumbing and configured to sense the pressure of the fluid in the outlet plumbing and provide a sensed pressure signal containing information about the pressure of the fluid in the fluid system; and a pump control module having a signal processor configured to implement an algorithm to:

provide an electrical power signal having increasing power over time to the pump unit for pumping the fluid to the fluid system in order to increase the speed and output pressure of the pump;

sense that current is no longer flowing to the pump unit indicating that the pressure switch opened and turned off the pump unit;

receive the sensed pressure signal containing information about the sensed pressure of the fluid in the in the outlet plumbing in relation to when the current stopped flowing to the pump unit; and determine a normal operating pressure for pumping the fluid to the fluid system based at least partly on the sensed pressure, the normal operating pressure being sufficiently below the sensed pressure so as to avoid substantially repeated switching action of the pressure switch without being so low as to penalize substantially the performance of the pump unit and fluid system.

15. A pumping system according to claim 14, wherein the pump control module is configured to provide a control signal containing information to operate the pump unit for pumping the fluid to the fluid system at the normal operating pressure.

16. A pumping system according to claim 14, wherein the pump control module is configured to determine the normal operating pressure based at least partly on determining the pressure at which current no longer flows to the pump unit in consequence of an applied voltage, and based at least partly on the algorithm for increasing the voltage applied to the pump unit until the current is no longer sensed as flowing to the pump unit in consequence of the applied voltage.

17. A pumping system according to claim 14, wherein the pump control module is configured to increase the power in the electrical power signal by increasing the voltage in the electrical power signal.

18. A pumping system according to claim 14, wherein the pump control module is configured to increase linearly over time the power in the electrical power signal.

19. A pumping system according to claim 14, wherein the pump control module is configured to increase the power in the electrical power signal by increasing the magnitude of the voltage in the electrical power signal.

20. A pumping system according to claim 14, wherein the pump control module is configured to use a value of the sensed pressure just before current is sensed as no longer flowing to the pump unit.

* * * * *